US005226377A

United States Patent [19]

Kastre

[11] Patent Number: 5,226,377

[45] Date of Patent: Jul. 13, 1993

[54] SINGLE AND DOUBLE TOED PRESSURE FEET FOR SEWING THICK MATERIAL

[76] Inventor: John D. Kastre, 322 E. Lehi Rd., Mesa, Ariz. 85201

[21] Appl. No.: 883,124

[22] Filed: May 14, 1992

[51] Int. Cl.[5] ..... D05B 29/04; D05B 27/04

[52] U.S. Cl. ..... 112/60; 112/235; 112/260; 112/321

[58] Field of Search ..... 112/28, 34, 36, 37, 112/47, 54, 60, 61, 227, 235, 236, 260, 308, 309, 310, 311, 320, 321

[56] References Cited

U.S. PATENT DOCUMENTS

| | | | |
|---|---|---|---|
| 319,766 | 6/1885 | White | 112/28 |
| 887,895 | 5/1908 | Witkus | 112/260 |
| 1,013,204 | 1/1912 | Molyneux | 112/260 |
| 1,017,164 | 2/1912 | Noble | 112/320 |
| 1,241,182 | 9/1917 | Wilson | 112/260 |
| 1,311,880 | 8/1919 | De Voe | 112/320 |
| 1,791,321 | 2/1931 | Myers | 112/260 X |
| 2,182,929 | 12/1939 | Mueller | 112/320 |
| 2,190,355 | 2/1940 | Engel | 112/47 |
| 2,235,753 | 3/1941 | Waterman | 112/54 |
| 2,474,282 | 6/1949 | Sailer | 112/320 |
| 2,583,735 | 1/1952 | Hayes | 112/260 X |
| 2,820,462 | 1/1958 | Doerr et al. | 112/320 |
| 3,437,062 | 4/1969 | Hacklander | 112/320 |
| 3,552,339 | 1/1971 | Seaman | 112/320 |
| 4,991,526 | 2/1991 | Blanc | 112/227 |
| 5,105,751 | 4/1992 | Ulmen et al. | 112/310 |

FOREIGN PATENT DOCUMENTS

| | | | |
|---|---|---|---|
| 0511454 | 3/1955 | Canada | 112/47 |

*Primary Examiner*—Clifford D. Crowder
*Assistant Examiner*—Ismael Izaguirre
*Attorney, Agent, or Firm*—Antonio R. Durando; Harry M. Weiss

[57] ABSTRACT

A set of modified plate and needle pressure feet for use in a standard commercial sewing machine. The plate pressure foot features a single inside toe that is narrower and shifted closer to its bar, and therefore to the needle, than in standard machines. The needle pressure foot consists of two separate toes, instead of the normal slotted structure, and is asymmetric with a narrower inside toe that accommodates the shift of the plate pressure foot towards the needle. A raised needle plate insert is also provided with a rounded outside edge, for smoother advancement of the material, and a flat inside edge, for better support of the material against the narrower plate pressure foot. These accessory parts, in combination, allow a user to sew a narrower seam and smaller corners than otherwise possible with conventional equipment.

6 Claims, 10 Drawing Sheets

SINGLE AND DOUBLE TOED PRESSURE FEET FOR SEWING THICK MATERIAL

BACKGROUND OF THE INVENTION

1. Field of the Invention

This invention is related to the general field of sewing machines and accessories to improve their versatility. In particular, the invention provides a new set of accessories designed specifically to enable the sewing of narrow strips and corners of thick, or hard to penetrate, material that cannot otherwise be sewn with standard equipment.

2. Description of the Related Art

The general workings of a sewing machine are the same whether designed for thin fabric, such as in clothing, or for thick material, such as in leather or multilayer applications. The material is fed forward while being held with the layers to be sewn facing toward the inside and through the stitching mechanism of the machine. The upper portion of the sewing mechanism includes a stroking vertical needle, threaded with an upper thread, that moves up and down through a horizontal needle plate. The material to be sewn is fed over the needle plate and automatically moved forward between stitches by a toothed feeding mechanism that works either within or in cooperation with the plate. During each stitching cycle, a pressure foot clamps the layers of material being sewn on the needle plate while the downward motion of the threaded needle pierces through the material to start the stitch. Upon reaching the other side of the needle plate, the upper thread is engaged by a lower thread carried by a shuttle hook in a rotating shuttle in the lower portion of the sewing mechanism. The needle then reverses its motion and carries the lower thread, engaged by the upper thread, through the stitch hole in its upward travel. As the needle releases the material in its upward travel, the pressure foot also releases its clamp on the material, which thus remains free to be shifted forward by the feeding mechanism. The cycle then begins anew as the pressure foot moves down to clamp the material and the needle goes through it in its new position (that is, one stitch forward from the old one).

Another kind of machine functions essentially the same way, except that the material is fed through by the forward displacement of the needle while it moves upwards at the end of each stitch. The material is kept in place by the pressure foot while the needle travels downward to engage the lower thread; the pressure foot is then lifted slightly as the needle travels upward and forward, thus displacing the material to a new stitch position; and finally the pressure foot again clamps the material against the needle plate as the needle is released from the material and shifts backward to initiate a new stitch cycle. U.S. Pat. No. 4,991,526 to Jean Blanc (1991) describes such a sewing machine incorporating a modified needle plate insert and a pressure foot for improved stitching of thick material. The invention comprises a needle-receiving slot that provides a side guide for avoiding needle deflections and loss of stitches otherwise caused by the needle penetration into thick layers of material.

Some machines feature two pressure feet, instead of only one. The first one is a plate pressure foot that serves the same general purpose of the single pressure foot in other machines; that is, it clamps the material to the needle plate while the needle is forming the stitch and it releases the material while it is being advanced between stitches. The second one is a needle pressure foot that serves as an additional clamp to the material during the penetration of the needle and as a feeding mechanism, in conjunction with the needle, to move the material forward between stitches. The needle pressure foot is typically smaller and contained within the toes of the larger plate pressure foot. The needle pressure foot and the needle remain parallel at all times and shift their horizontal position together moving forward as the plate pressure foot is released during the needle's upward stroke, and then they shift back together, free of the material, to start a new stitch during the needle's downward stroke after the plate pressure foot has again pinned the material to the needle plate. To my knowledge, prior art pressure feet are generally symmetrical and consist of two toes, one on the inside and the other on the outside of the vertical needle, that press on the material being sewn. In the case of double pressure-foot machines, the two toes of the needle pressure foot are usually connected at the tip, defining a hole or slot at the center of the foot through which the needle travels during the stitching operation.

One of the problems common to all kinds of machines is the difficulty encountered while trying to sew along narrow seams and corners, especially when the material is thick or also hard to penetrate, such as leather in saddle making. The present invention is an improvement of the double pressure-foot type of machine, directed at providing modified pressure feet and other accessory parts that make it possible to sew narrower seams in both thin and thick material and to place stitches in corners or other difficult-to-reach spots than is currently possible with standard equipment.

BRIEF SUMMARY OF THE INVENTION

The main objective of this invention is the development of a set of accessory parts for existing commercial sewing machines that improve their versatility of operation.

Another goal is the ability to sew adjacent layers of any material when the abutting edges form a narrow strip or a tight corner that cannot be accessed by the needle of standard equipment.

Another objective is a set of accessory parts that are particularly suited for improving the performance of sewing machines when the material used is thick or hard-to-penetrate.

A further goal of the invention is a set of accessories that can be manufactured economically by using commercially available materials, components and techniques.

According to these and other objectives, this invention comprises a set of modified plate and needle pressure feet for use in a standard commercial sewing machine. The plate pressure foot features a single inside toe that is narrower and shifted closer to its bar, and therefore to the needle, than in standard machines. The needle pressure foot consists of two separate toes, instead of the normal slotted structure, and is asymmetric with a narrower inside toe that accommodates the shift of the plate pressure foot towards the needle. A raised needle plate insert is also provided with a rounded outside edge, for smoother advancement of the material, and a flat inside edge, for better support of the material against the narrower plate pressure foot. These accessory parts, in combination, allow a user to sew a narrower seam and smaller corners than otherwise possible with conventional equipment.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose but one of the various ways in which the invention may be practiced.

DESCRIPTION OF THE PREFERRED EMBODIMENTS

Figure 1B:
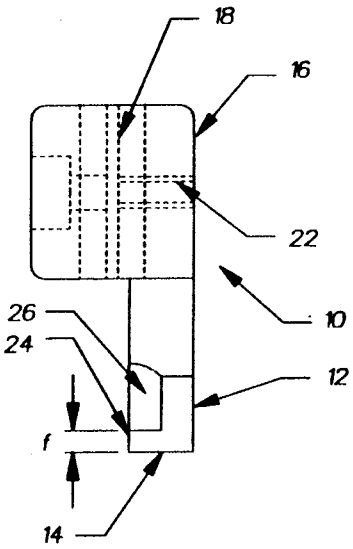
FIG. 1*b* is a front view of the same plate pressure foot as seen from the front of the machine.

This invention is very specific in its purpose and definition. It is primarily directed at modifying the pressure feet and the plate inserts of conventional sewing machines in order to achieve the objective of successfully placing stitches through thick material when a very narrow or curved seam is available with which to work. Since the plate pressure foot constitutes a barrier to the material's reach toward the needle during the sewing operation, the width of the outside toe in the plate pressure foot determines the minimum width of the seam. Therefore, a narrower seam can be sewn by reducing the outside width of the plate pressure foot or eliminating it altogether. At the same time, the reach of the material must be beyond the position of the needle to permit the needle pressure foot to clamp it against the needle plate and keep it in place while the needle penetrates it to form a stitch and also to permit the plate pressure foot to clamp it in place while the needle and the needle pressure foot are shifting back at the end of each stitch. Thus, both pressure feet and the needle plate must be modified to allow clamping of the material even when only a very narrow strip of material extends past the needle position. Although these conceptual modifications are applicable to any standard double pressure-foot machine, the preferred embodiment of this invention is described with reference to two machines manufactured by Durkopp Adler America, Inc. of Norcross, Ga., specifically Adler Models 205-370 and 205-374.

Referring to the drawings, wherein like parts are referenced throughout with like numerals and symbols, FIGS. 1 through 4 describe the accessory parts of this invention as specifically designed for use on one of these machines. Therefore, all dimensions and details specified herein correspond to modifications with respect to the standard parts currently provided with these machines; to the extent that specific dimensions are not given, they are the same as in the standard parts. FIG. 1*a* is a side view of the plate pressure foot 10 of the invention as seen from outside the machine. For the purpose of this description, the outside of the machine is defined as the side of the needle on which the material to be sewn is positioned and the inside of the needle is defined as the side on which the seam protrudes. The front of the machine is defined as the side on which an operator stands while feeding the material through the machine. Thus, in a left-hand machine the operator would stand in front of the machine and feed the right edge of the material through the stitching mechanism with his or her right hand while holding the material with his or her left hand.

Figure 1C:
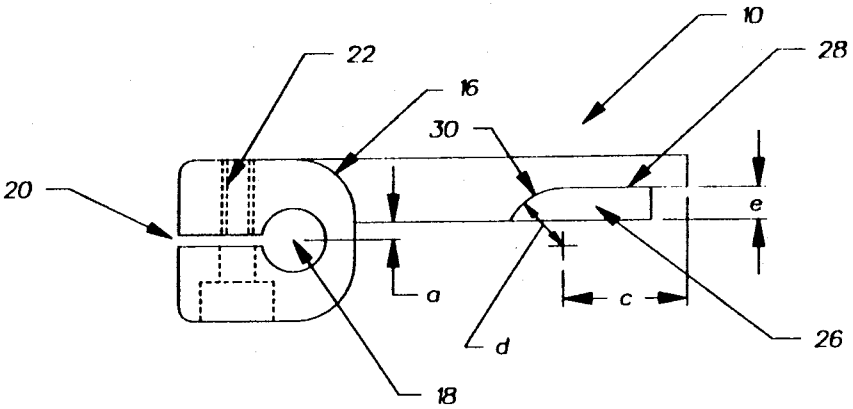
FIG. 1*c* is a top view of the plate pressure foot of FIGS. 1*a* and 1*b*.
Figure 1A:
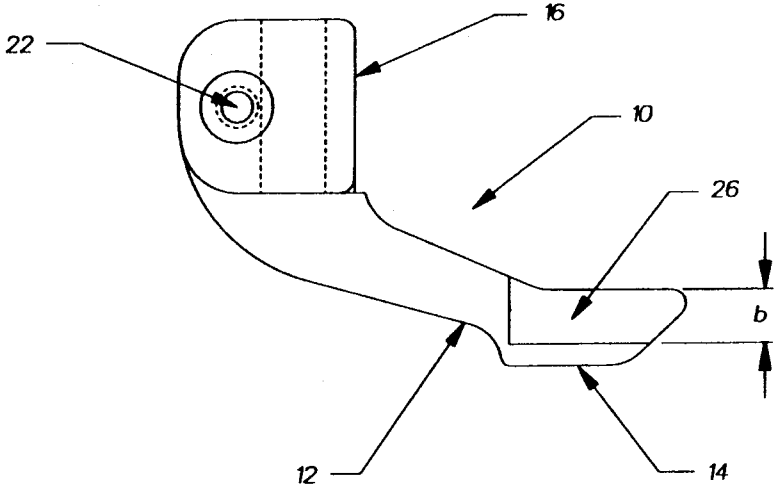
FIG. 1*a* is a 1.5:1 scale side view of the plate pressure foot of the invention as seen from the side of the machine.

Thus, FIG. 1*b* is a front view of the plate pressure foot 10 as seen from the front of the machine and FIG. 1*c* is a top view thereof. As clearly illustrated in the front view, the plate pressure foot 10 features a single toe 12 having a flat base 14 for exerting pressure over the material to be sewn. A neck 16 is provided with a vertical cylindrical throat 18 for receiving and clamping the foot 10 over a vertical plate pressure foot bar 78 (seen in FIG. 7) which controls the vertical movement of the plate pressure foot 10. The neck 16 also features a vertical slit 20 that provides a means for adjusting the tightness of the grip of the throat 18 around the bar 78. In addition, a lateral threaded channel 22 is provided on the side of the neck 16 for an adjustment screw (not shown in these figures) to tighten the grip of the throat 18 over the bar 78. As mentioned above, the inside edge 24 of the toe 12 of the plate pressure foot 10 is closer to the axis of the bar 78, and therefore it is also closer to the needle of the machine, than in standard plate pressure foot configurations, thus requiring less material extending past the needle before it can be caught and kept in place by the toe. The distance a, as seen in FIG. 1*c*, between the toe 12 and the parallel plane passing through the needle is approximately 0.075 inches (0.1905 cm). The inside of the toe 12 features an indentation 26 having a generally vertical surface with a depth b of (FIG. 1*a*) approximately 0.232 inches (0.5893 cm) and consisting of a straight portion 28 about 0.528 inches (1.3411 cm) long (shown as c in FIG. 1*c*) and a curved portion 30 with a radius d about 0.215 inches (0.5461 cm) long. The bottom surface of the indentation 26 has a width e approximately 0.140 inches (0.3556 cm)

at the tip of the toe tapering to zero along the surface 30 (seen in FIG. 1*c*). Finally, the thickness f of the indented portion of the toe 12 is approximately 0.093 inches (0.2362 cm). As will become apparent from the functional description given below, these specific dimensions ensure that the plate pressure foot 10 can operate in combination with the other modified components of the sewing machine without interfering with the motion of the various parts. Specifically, this size indentation ensures that the needle bar can clear the plate pressure foot irrespective of the thickness of the material being sewn.

Figure 2B:
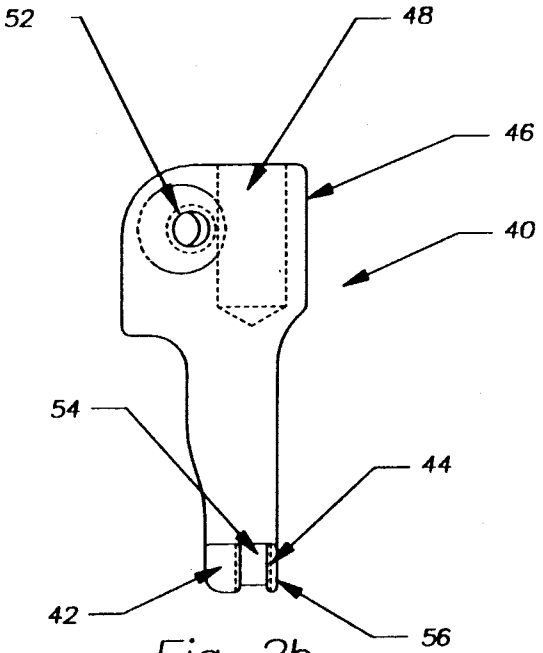
FIG. 2*b* is a front view of the same needle pressure foot as seen from the front of the machine.
Figure 2C:
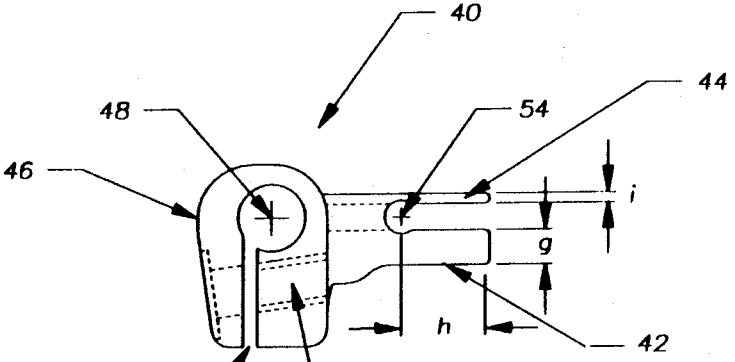
FIG. 2*c* is a top view of the needle pressure foot of FIGS. 2*a* and 2*b*.
Figure 2A:
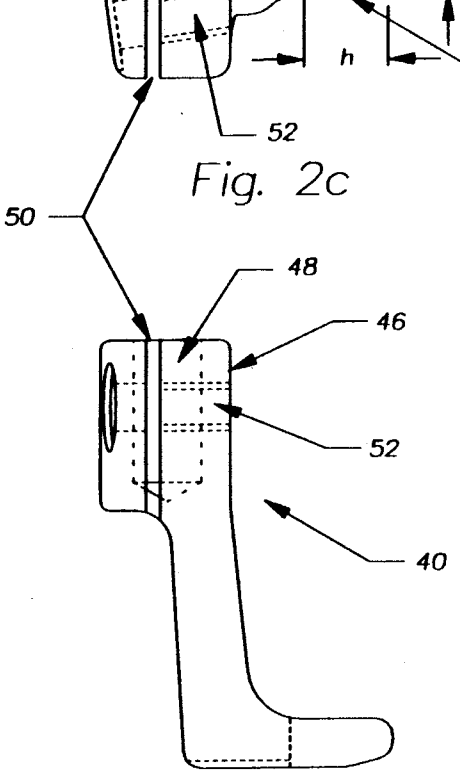
FIG. 2*a* is a 1.5:1 scale side view of the needle pressure foot of the invention as seen from outside the machine.

FIGS. 2*a*, 2*b* and 2*c* are schematic side, front and top views, respectively, of the needle pressure foot 40. It features an outside toe 42 having a width g of approximately 0.122 inches (0.3099 cm) and a length h of about 0.31 inches (0.7874 cm); also a thinner inside toe 44 having a width i of 0.035 inches (0.0889 cm). Each toe has a base (much narrower in the outside toe than in the inside toe) for exerting pressure over the material to be sewn. In a manner similar to the structure described above for the plate pressure foot 10, a neck 46 is provided with a vertical cylindrical throat 48 for receiving and clamping the foot 40 over a corresponding vertical needle pressure foot bar 76 (seen in FIG. 7) which controls the vertical movement of the needle pressure foot 40. The neck 46 also features a vertical slit 50 that provides a means for adjusting the tightness of the grip of the throat 48 around the bar 76. In addition, a lateral threaded channel 52 is provided on the side of the neck 46 for an adjustment screw (also not shown in these figures) to tighten the grip of the throat 48 over the bar 76. As will become clear from the functional description given below, the needle pressure foot 40 operates in close proximity to the plate pressure foot 10. Both feet move vertically along axes parallel to the axis of the sewing needle, with the needle traveling through the vertical opening 54 between the two toes 42 and 44 of the needle pressure foot. At the same time, the plate pressure foot is positioned in close spatial relationship to the needle pressure foot, with the inside edge 24 of its single toe 12 being very close to, but without touching, the outside edge 56 of the inside toe 44. Thus, the very thin inside toe 44 makes it possible for the single toe 12 of the plate pressure foot to operate in closer proximity to the needle than is possible with standard equipment. The result is that a narrower seam can be sewn on any material. Moreover, the two toes 42 and 44 of the invention, rather than being connected at the tip to form an enclosed needle slot, are separated by the slit opening 54 that provides better visibility of the stitches and easier access to the threads than available while sewing with standard equipment.

Figure 3D:
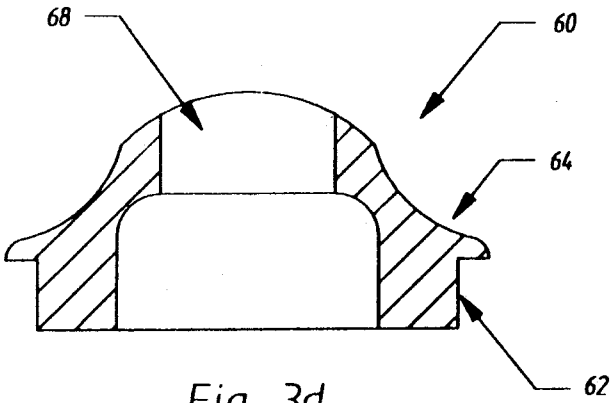
FIG. 3*d* is a cross-sectional view of the raised plate insert of FIG. 1.
Figure 3B:
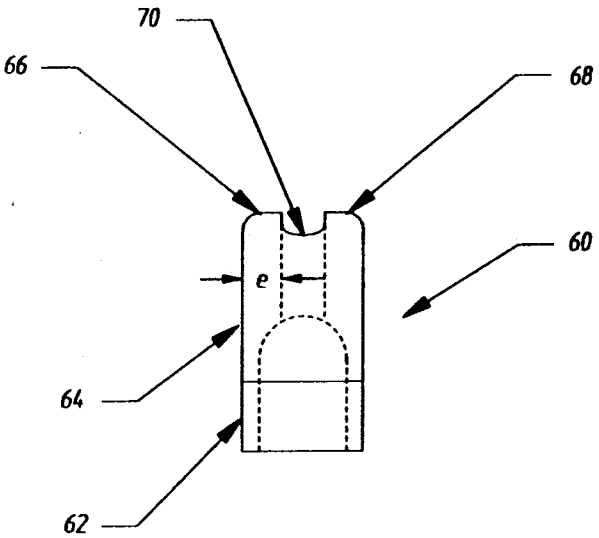
FIG. 3*b* is a front view of the same raised plate insert.
Figure 3C:
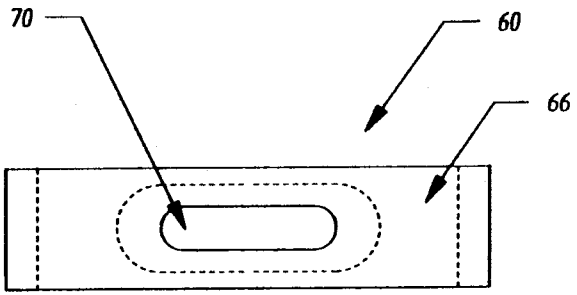
FIG. 3*c* is a top view of the raised plate insert of FIGS. 3*a* and 3*b*.
Figure 3A:
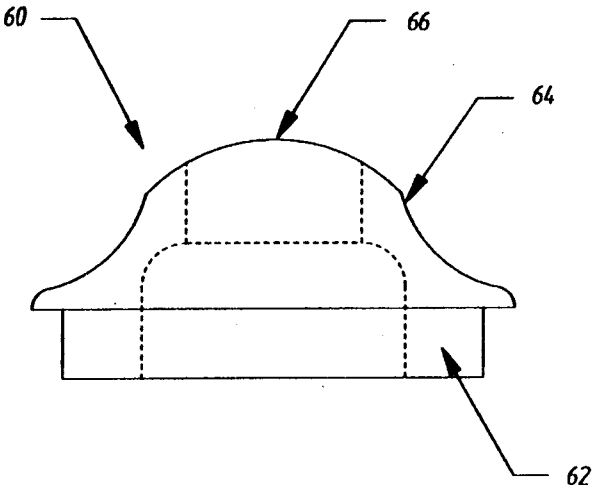
FIG. 3*a* is a 2:1 scale side view of the raised plate insert of the invention.
Figure 4:
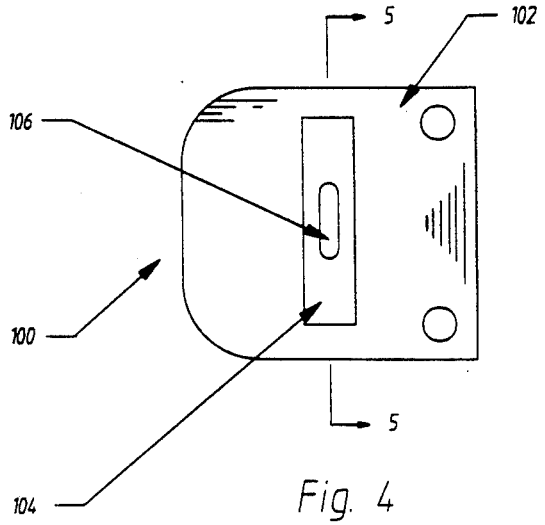
Fig. 4 (PRIOR ART)
FIG. 4 is a top view of a needle plate and insert according to the prior art.
Figure 5:
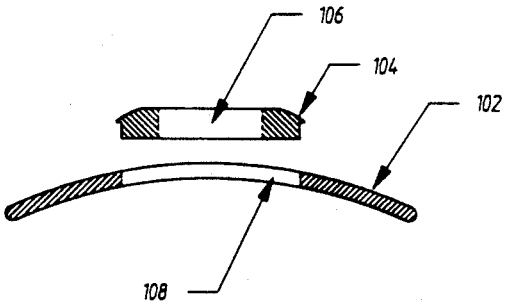
Fig. 5 (PRIOR ART)
FIG. 5 is a cross-sectional view of the same needle plate and insert taken from line 5—5 of FIG. 4.
Figure 6:
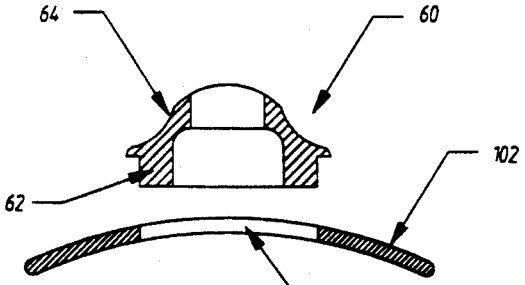
FIG. 6 is a cross-sectional view of the same needle plate with the raised insert of the present invention.

In order to fully exploit the features described above to reach otherwise unreachable sites for sewing various thicknesses of material, a special plate insert has also been designed, as illustrated in FIGS. 3*a*–3*d*. A top view of a conventional needle plate 100 is shown in FIG. 4, which illustrates a plate base 102 housing an insert 104 containing a needle slot 106 through which the needle travels vertically while stitching the material. As shown in the cross-sectional view of FIG. 5, the insert 104 is removable from an opening 108 in the base 102 of the needle plate. Thus, the raised plate insert 60 illustrated in FIGS. 3*a*, 3*b* and 3*c* in side, front and top view, respectively, can be inserted in the same opening 108 of the base plate 102, as shown in the cross-sectional view of FIG. 6. The raised plate insert 60 is designed to enable the sewing of narrow strips of material attached to material portions that cannot be fed through the lower, relatively flat, conventional needle plate. For example, in sewing the bottom edge of a leather briefcase, the seam typically combines two leather sheets that come together at an angle of approximately 90 degrees to form an edge at some angle therebetween; therefore, it is very difficult to insert the seam far enough over the needle plate to effect a stitch. Typically, the angle between the seam and the connecting structure causes the material adjacent to the seam to butt against the needle plate and preclude its reaching over the needle.

The purpose of the raised plate insert 60 is to provide space below the point where the seam is formed so that the material connected to the seam can fit over the needle plate during the stitching of the seam. As also illustrated in the Blanc patent referenced above, the raised plate insert 60 consists of a substitute for the substantially flat needle plate insert provided as standard equipment. The indented lower portion 62 of the plate is designed to fit into a standard needle plate as an insert so that the upper portion 64 extends above the plate. In the preferred embodiment, the upper portion 64 is raised approximately 0.49 inches (1.2446 cm) over the plate, thus providing room below the stitch surface. This dimension is chosen for the Adler machines because it represents a practical compromise in the tradeoff between added space and maximum utilization of the equipment for sewing thick material, even though the raised insert obviously reduces the stroke size of the needle. The top surface 66 of the upper portion 64 consists of an outside longitudinal shoulder 66 and an inside longitudinal shoulder 68 that define a needle slot 70 (FIG. 3*c*). Both shoulders are rounded in the direction of advancement of the material during sewing, so that the material is at its highest elevation with respect to the plate as the needle is forming the stitch through it. In the preferred embodiment, the top surface 66 is curved with an approximate radius of 0.5 inches (1.2700 cm); which I found to be sufficient to permit stitching of recessed and curved surfaces in leather. Moreover, in order to facilitate the smooth advancement of the material over the top surface 66, the outside edge of the shoulder 66 is also rounded, as seen in FIG. 3*b*. On the other hand, in order to retain the maximum contact surface with, and the clamping effect of, the single toe 12 of the needle plate pressure foot, the outside edge of the shoulder 68 is not similarly rounded. The needle slot 70 should be approximately the same width as the distance between the two toes 42 and 44 of the needle pressure foot in order to provide maximum support for the material being sewn. In addition, the width 1 of the outside shoulder 64 (FIG. 3*b*) should be the same as that of the outside toe 42, so that the two structures are vertically aligned for maximum clamping and equal interference (minimal) with the material as the seam is put through to reach the needle. In the preferred embodiment, this width 1 is about 0.11 inches (0.2794 cm), which corresponds to the width of the standard-size outside toe 42. The length of the needle slot is determined by the travel required by the needle to perform the desired stitching functions and is not specific to the invention. I found, though, that the longest stitches available in the standard machines (10 mm) are too long for sewing corners and narrow seams, so that a shorter needle slot 70 is appropriate for the raised plate insert 60. A length of 5 mm was used for the preferred embodiment of the invention.

As a result of the described specific combination of features and dimensions, the three accessory parts shown in FIGS. 1–3 permit the Adler 205-370 and 205-374 machines to be used for sewing corners and narrow seams of material that cannot be reached with standard accessories. On the outside of the machine, the elimination of the outside toe in the plate pressure foot and the raised plate insert enable the material to come closer to the sewing needle, thus making it possible to stitch together low radius seams and narrow strips of material exposed from bulky structures. On the inside of the machine, the narrower inside toe of the needle pressure foot enables the single toe of the plate pressure foot to operate closer to the needle, which permits the stitching of a seam when less overlap of material is available past the stitching line. Finally, because of the open gap between the two toes of the needle pressure foot, the threads can be more easily reached and the stitches can be seen during the operation of the machine.

It should be noted that the raised insert 60 is not essential to the operation of the sewing machine with the pressure-foot accessories of this invention. It only becomes necessary to further improve the machine's ability to reach and sew tight spots, such as corners and narrow strips, but a good degree of improvement is achieved even without the use of the insert. In fact, to the extent that the insert 60 necessarily raises the stitching surface above its original elevation, it obviously decreases the space available for sewing thick material because of the shorter vertical travel remaining available to the needle and the pressure feet. Therefore, when sewing the maximum thickness specified for these machines (1 inch or 2.54 cm), it is advisable to use the standard insert 104 rather than the raised insert 60.

FIGS. 7 through 10 illustrate the functioning of the accessory parts of the invention, as viewed from the outside of the referenced left-hand Adler machines. The upper portion of the sewing mechanism comprises the needle 72 attached to a vertically stroking needle bar 74 which is positioned directly above the opening 54 between the two toes of the needle pressure foot 40, which is itself fastened to and driven by a needle pressure foot bar 76. The plate pressure foot 10 is similarly attached to and driven by a plate pressure foot bar 78 and is positioned on the inside of the needle and the needle pressure foot. The needle 72 is threaded with an upper thread 80 being spooled from the top of the machine. The lower portion of the sewing mechanism comprises the needle plate base 102 with the raised insert 60, which is shown as supporting a top layer T and a bottom layer B of the material being sewn. Stitches S through the material are formed as the needle travels up and down carrying the upper thread 80 and a lower thread 82 delivered from a bobbin case 84 contained in a shuttle assembly 86 below the needle plate.

Figure 11:
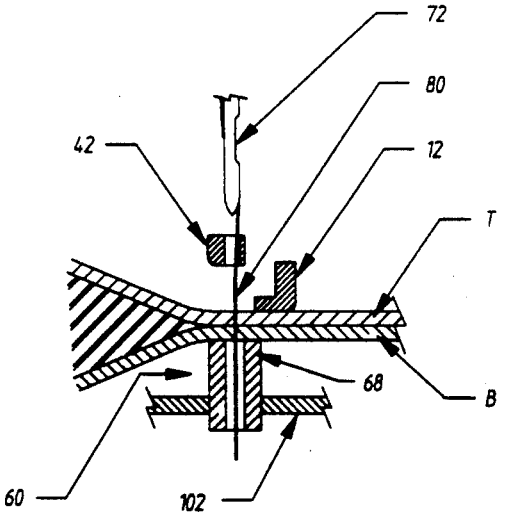
FIG. 11 is a partial cross-sectional view of the accessory parts of the invention taken from the front of the machine in the position illustrated in FIG. 7.
Figure 7:
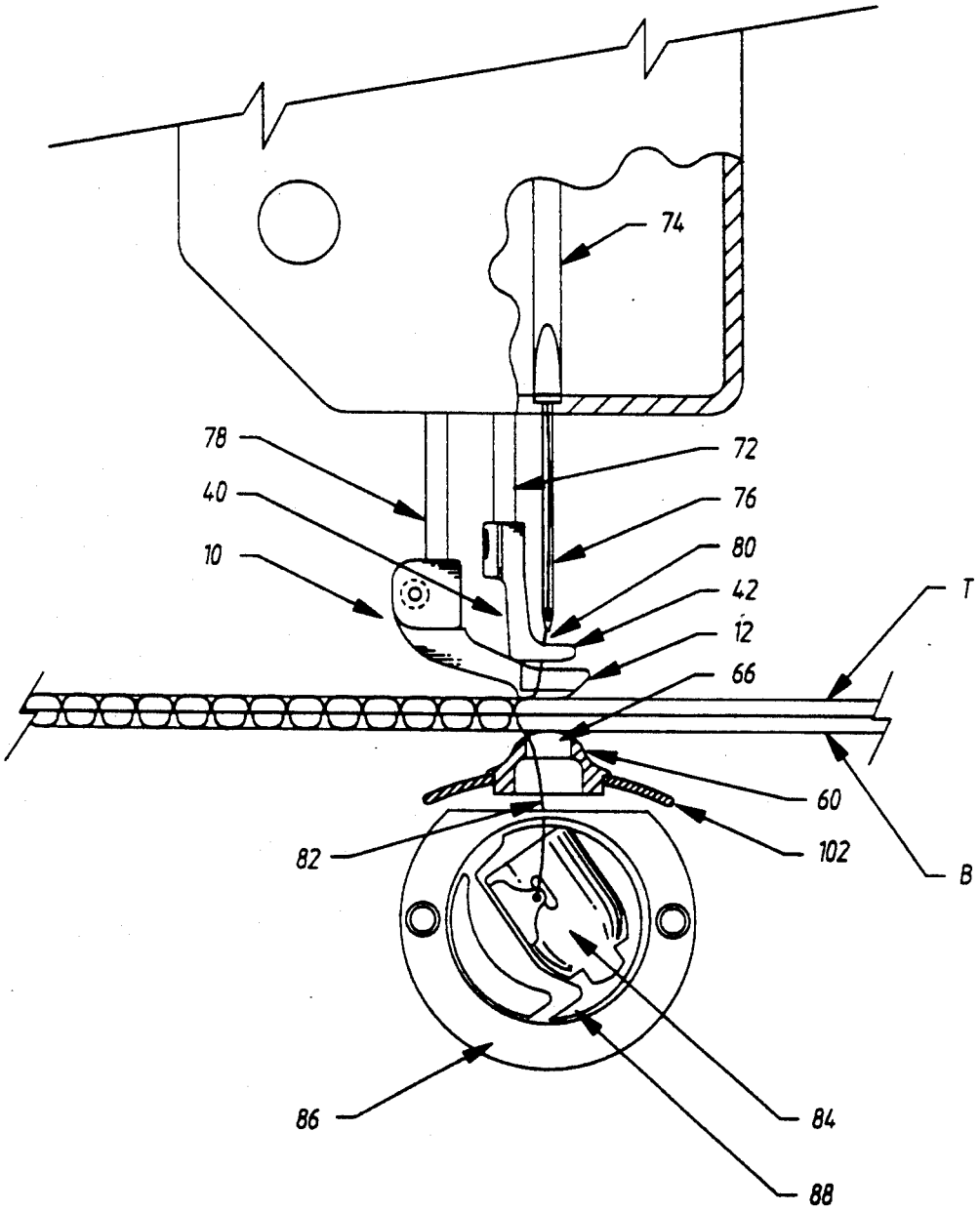
FIGS. 7 through 10 illustrate the functioning of the accessory parts of the invention, as viewed from the outside of the left-hand Adler machines.

Choosing FIG. 7, arbitrarily, as representing the beginning of the stitching cycle, the material is clamped in stitching position by the toe 12 of the plate pressure foot 10, which presses the two layers of material (T and B) against the surface 66 of the raised insert 60. Specifically, as illustrated in the partial cross-sectional front view of FIG. 11, the single toe 12 presses only on the inside shoulder 68 of the plate insert 60.

Figure 8:
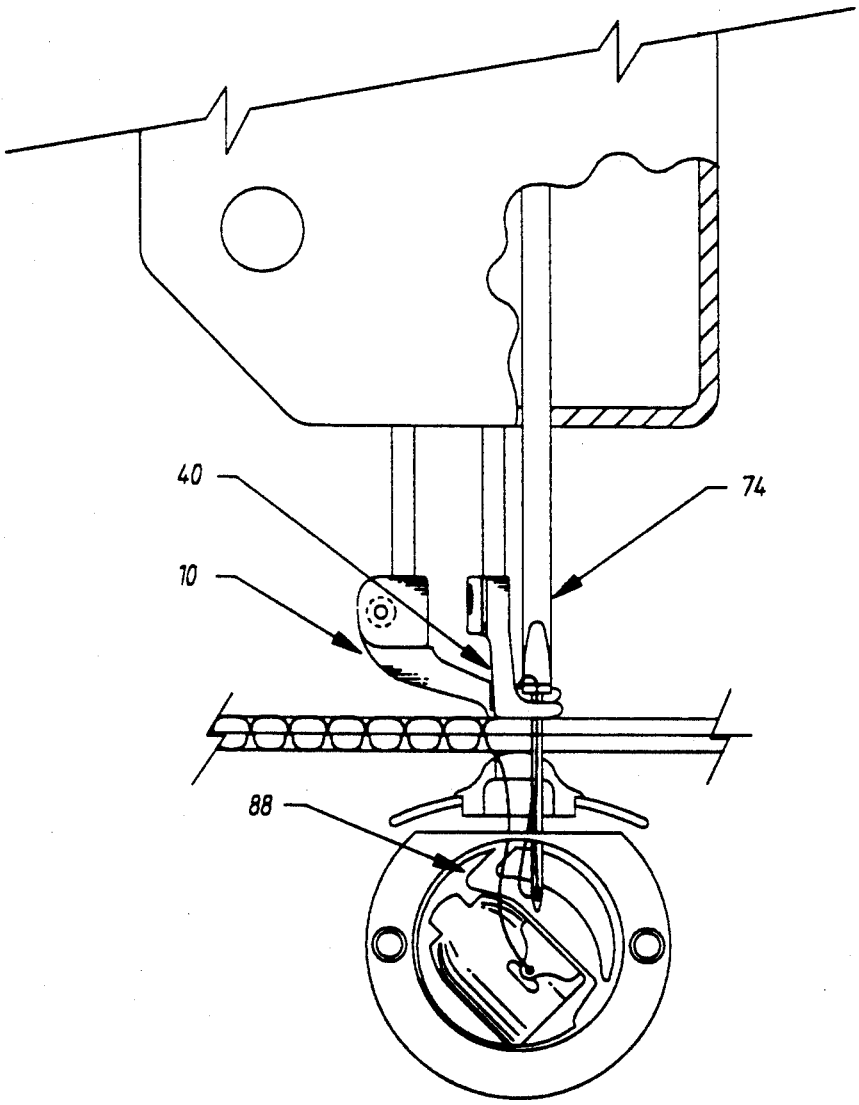

The needle 72 and the needle pressure foot 40 are in a raised position clear of the material, leaving only the plate pressure foot as a retaining structure. Starting from this point, the needle bar 74 and the needle pressure foot bar 76, working together and in parallel, begin shifting backwards as they move downward to start the stitch cycle. The needle pressure foot clamps the material and the needle pierces through it carrying the upper thread 80 until it reaches the bottom of its stroke. FIG. 8 illustrates this stage of the cycle, wherein the needle is at its lowest position and both feet are pressing against the material. At this point the shuttle hook 88 in the shuttle assembly 86 engages the upper thread 80 in the needle below the plate and inserts the lower thread 82 through it. The needle then reverses its motion and carries the lower thread, engaged by the upper thread, through the stitch hole in its upward travel.

Figure 9:
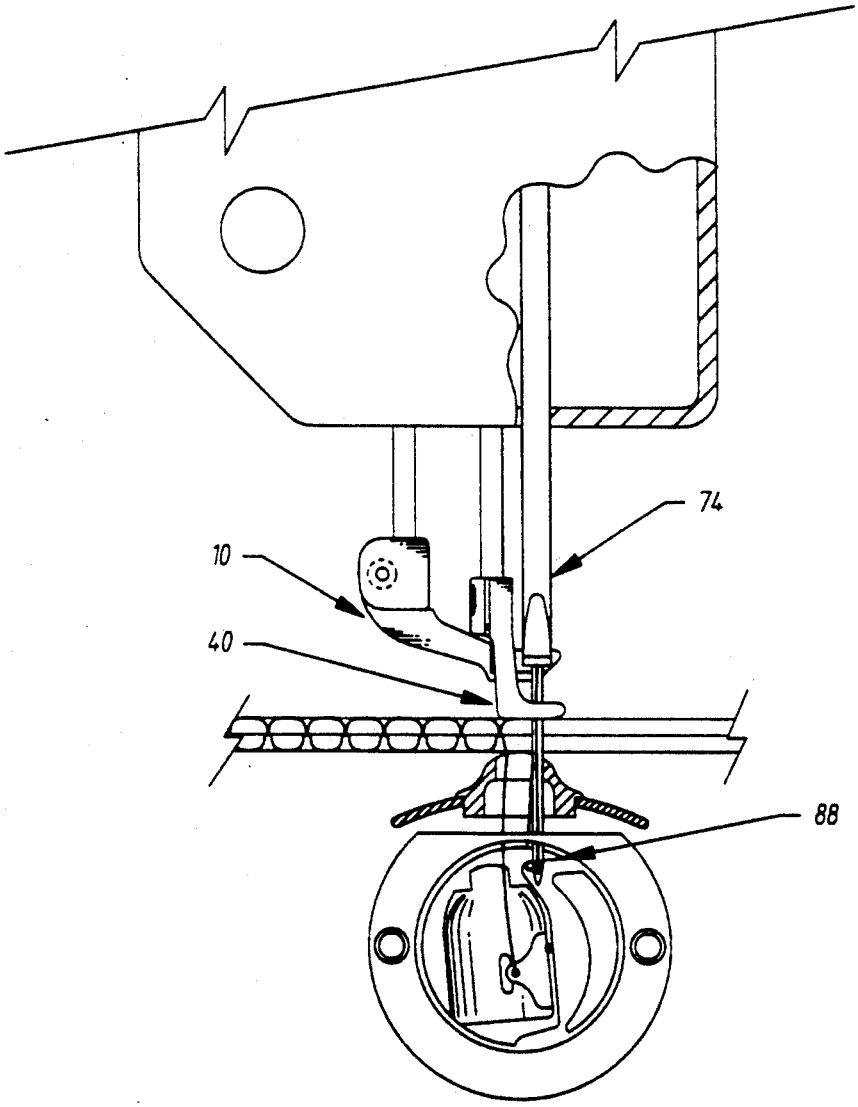
Figure 10:
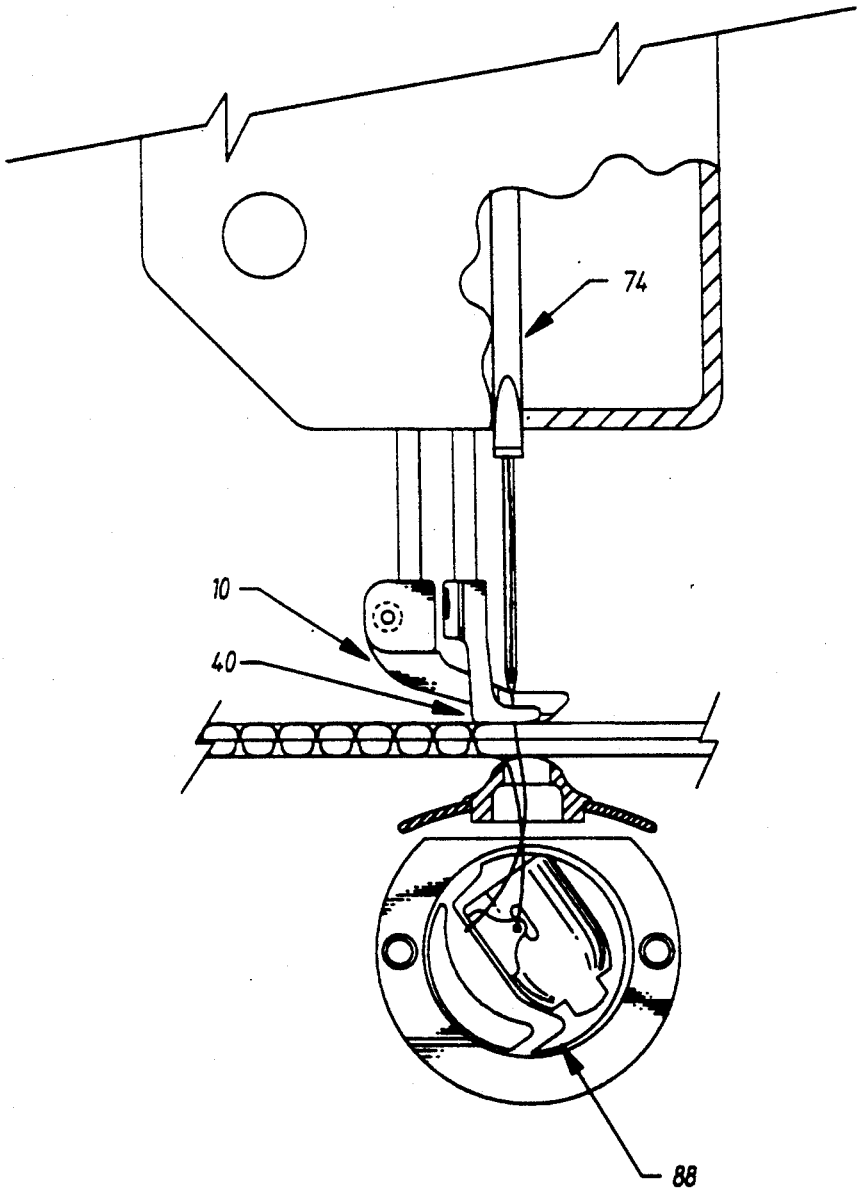
Figure 13:
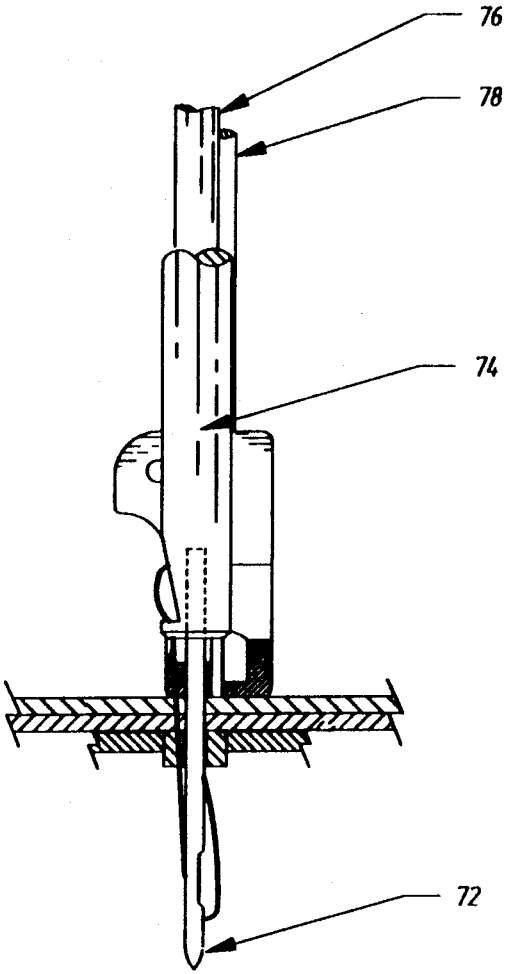
FIGS. 12 through 15 illustrate the same sequence of functional steps of FIGS. 7–10, but shown in front view.
Figure 12:
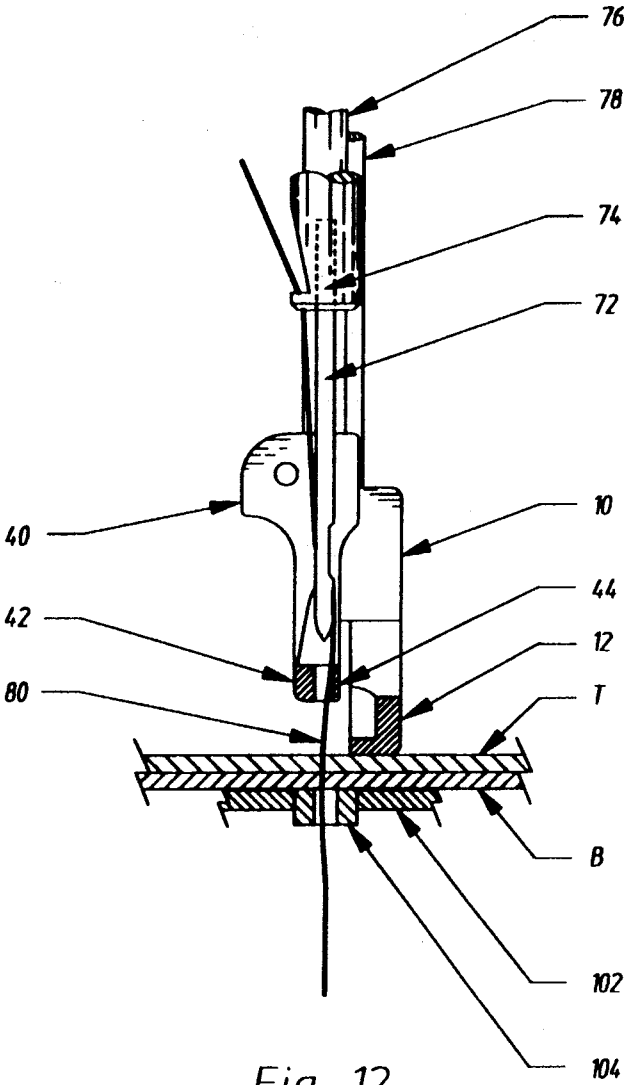
Figure 15:
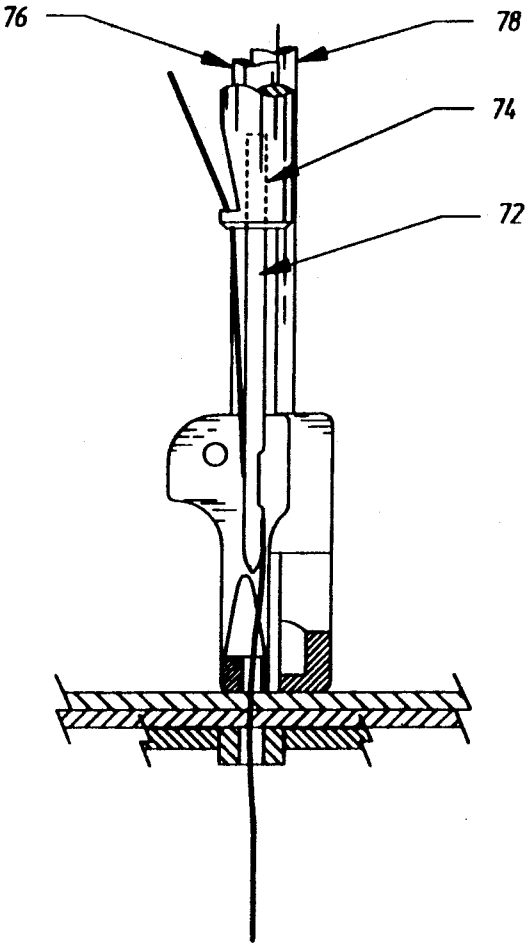
Figure 14:
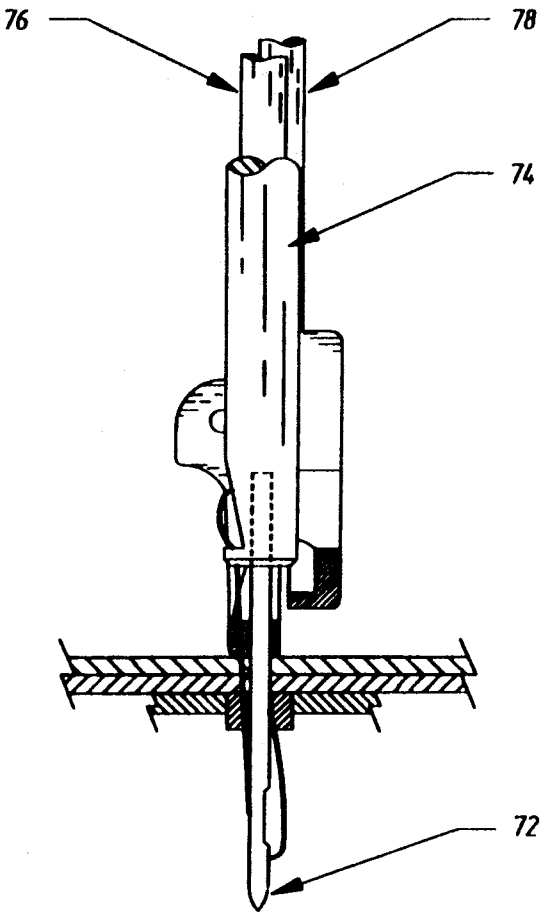

As the needle begins moving upward, the plate pressure foot is lifted to release the material, as seen in FIG. 9. The needle pressure foot and the needle, moving together, then shift forward a distance equal to the length of one stitch, as set by the operator, carrying the material forward with them. As soon as this advancement is effected, the plate pressure foot is again lowered to clamp the material in its new position while the needle continues its upward stroke and finally comes out of the material. This is the stage illustrated in FIG. 10. Finally the needle pressure foot is again raised to start a new cycle from the position shown in FIG. 7.

For additional illustration, the same sequence of functional steps is shown in front view in FIGS. 12 through 15. Instead of illustrating the use of the raised insert 60, though, these partial cross-sectional figures show the machine in use with a standard needle plate.

Various changes in the details, steps and materials that have been described may be made by those skilled in the art within the principles and scope of the invention herein illustrated and defined in the appended claims. Therefore, while the present invention has been shown and described herein in what is believed to be the most practical and preferred embodiment, it is recognized that departures can be made therefrom within the scope of the invention, which is therefore not to be limited to the details disclosed herein, but is to be accorded the full scope of the claims so as to embrace any and all equivalent apparatus and methods.

I claim:

1. In a conventional sewing machine for sewing relatively thick material, wherein the machine comprises a needle mounted on a movable needle bar, a needle plate with an insert, a needle pressure foot and a plate pressure foot for cooperatively controlling a placement of stitches and an advancement of the material, the improvement comprising, in combination with said sewing machine:

(a) a needle pressure foot having a first toe and a second narrower toe; and (b) a plate pressure foot having a single toe positioned in close spatial relationship to said second narrower toe, said single toe having an indentation for ensuring that the plate pressure foot operates without interfering with the motion of the needle bar;

wherein said first toe and narrower toe of the needle pressure foot are set apart from each other by a slit opening providing visibility of the stitches and access to sewing threads during sewing; and wherein the narrower toe of said needle pressure foot has a width of 0.035 inches.

2. The improvement described in claim 1, wherein the first toe of said needle pressure foot has a width of 0.122 inches and a length of about 0.31 inches.

3. The improvement described in claim 2, wherein a distance between an inside edge of said single toe of the plate pressure foot and the needle of the machine is approximately 0.075 inches.

4. The improvement described in claim 3, wherein said indentation in the toe of the plate pressure foot comprises a generally vertical surface having a depth of approximately 0.232 inches and consisting of a straight portion about 0.528 inches long and a curved portion with a radius of about 0.215 inches, and a bottom surface having a width approximately 0.140 inches at a tip of the toe and tapering to zero along said vertical curved surface, wherein a thickness of the indented portion of said toe is approximately 0.093 inches.

5. In a conventional sewing machine that includes a needle mounted on a movable needle bar, a needle plate with an insert, a needle pressure foot and a plate pressure foot for cooperatively controlling a placement of stitches and an advancement of relatively thick material, a needle pressure foot and a plate pressure foot, wherein:

(a) said needle pressure foot comprises a first toe with a width of 0.122 inches and a length of about 0.31 inches, and a second narrower toe with a width of 0.035 inches, said toes being set apart by a slit opening providing visibility of the stitches and access to sewing threads during sewing; and (b) said plate pressure foot comprises a single toe positioned in close spatial relationship to said first toe of the needle pressure foot; said single toe having an indentation for ensuring that the plate pressure foot operates without interfering with the motion of the needle bar; and said indentation comprising a generally vertical surface having a depth of approximately 0.232 inches and consisting of a straight portion about 0.528 inches long and a curved portion with a radius of about 0.215 inches, and comprising a bottom surface having a width approximately 0.140 inches at a tip of the toe and tapering to zero along said vertical curved surface, wherein a thickness of the indented portion of said toe is approximately 0.093 inches;

wherein a distance between said single toe of the plate pressure foot and the needle of the machine is approximately 0.075 inches.

6. The machine described in claim 5, further comprising a raised needle plate insert consisting of a curved top surface with a first longitudinal shoulder and a second longitudinal shoulder, said shoulders defining a needle slot, both shoulders being rounded in a direction of advancement of the material during sewing, such that the material is at a highest elevation with respect to the needle plate at a point where a stitch is being formed, and said needle slot having approximately a same width as a distance between the two toes of said needle pressure foot for providing maximum support for the material being sewn;

wherein said top surface is curved with an approximate radius of 0.5 inches;

wherein an outside edge of said first longitudinal shoulder is rounded so as to facilitate a smooth advancement of the material over said curved top surface; and wherein a width of said first longitudinal should and a width of said first toe in the needle pressure foot are both 0.11 inches, such that said first longitudinal shoulder is vertically aligned with said first toe for maximum clamping and minimum interference with the material being advanced during sewing.

* * * * *

UNITED STATES PATENT AND TRADEMARK OFFICE

CERTIFICATE OF CORRECTION

PATENT NO. : 5,226,377
DATED : July 13, 1993
INVENTOR(S) : John D. Kastre

It is certified that error appears in the above-indentified patent and that said Letters Patent is hereby corrected as shown below:

Column 10, Claim 6, line 28, replace the word "should" with--shoulder--.

Signed and Sealed this

First Day of February, 1994

Bruce Lehman

*Attest:*

BRUCE LEHMAN

*Attesting Officer*

*Commissioner of Patents and Trademarks*